US011076239B2

(12) United States Patent
Liao

(10) Patent No.: US 11,076,239 B2
(45) Date of Patent: Jul. 27, 2021

(54) SOUND GENERATOR

(71) Applicant: AAC Technologies Pte. Ltd., Singapore (SG)

(72) Inventor: Huanbin Liao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/706,723

(22) Filed: Dec. 7, 2019

(65) Prior Publication Data

US 2020/0213758 A1 Jul. 2, 2020

(30) Foreign Application Priority Data

Dec. 31, 2018 (CN) ..... 201822272390.4

(51) Int. Cl.

| | |
|---|---|
| ***H04R 9/00*** | (2006.01) |
| ***H04R 9/06*** | (2006.01) |
| ***H04R 9/02*** | (2006.01) |
| ***H04R 7/18*** | (2006.01) |
| ***H04R 7/12*** | (2006.01) |

(52) U.S. Cl.
CPC ..... *H04R 9/06* (2013.01); *H04R 7/127* (2013.01); *H04R 7/18* (2013.01); *H04R 9/025* (2013.01); *H04R 2400/11* (2013.01)

(58) Field of Classification Search
CPC .... H04R 9/00; H04R 29/003; H04R 2209/00; H04R 2209/41
USPC ..... 381/400–402, 407–409
See application file for complete search history.

(56) References Cited

U.S. PATENT DOCUMENTS

| | | | | |
|---|---|---|---|---|
| 940,284 | A * | 11/1909 | Sargent | H04R 9/06 381/401 |
| 2,007,749 | A * | 7/1935 | Anderson | H04R 1/24 381/402 |
| 7,729,503 | B2 * | 6/2010 | Young | H04R 9/022 381/407 |
| 2005/0141746 | A1 * | 6/2005 | Kobayashi | H04R 9/041 381/424 |
| 2005/0185818 | A1 * | 8/2005 | Ishigaki | H04R 9/04 381/407 |

* cited by examiner

*Primary Examiner* — Suhan Ni
(74) *Attorney, Agent, or Firm* — W&G Law Group LLP

(57) ABSTRACT

The invention discloses a sound generator having a voice coil. The most outer layer of the voice coil is defined as a tailend layer (last layer), which is wound obliquely from a top of the penult layer adjacent to the diaphragm in a direction away from the diaphragm, so that the high frequency pit of the sound generator is improved. The most outer layer of the voice coil is not completely wound such that the most outer layer reduces the contacting area between the dome and the voice coil, which reduces the split vibration of the dome at high frequency and improves the high frequency-resonance performance.

6 Claims, 2 Drawing Sheets

SOUND GENERATOR

FIELD OF THE PRESENT DISCLOSURE

The present disclosure relates to the field of electroacoustic transducers, more particularly to a sound generator used in a mobile electronic device.

DESCRIPTION OF RELATED ART

With the arrival of the mobile internet era, the number of intelligent mobile equipment rises continuously. In a plurality of mobile equipment, the mobile phone is undoubtedly the most common, most portable mobile terminal equipment. At present, the functions of the mobile phone and the functions of the mobile phone are various. One of the functions of the mobile phone is a high-quality music function, and the sound generator, also known as a loudspeaker, in the mobile phone is one of the necessary component for achieving the high-quality music performance.

According to the quantity of the magnetic circuits, related sound generators include 3-magnetic-circuit ones and 5-magnetic circuit ones. Sound generators with 5-magnetic-circuit configuration have higher frequency resonance sensitivity than the ones with 3-magnetic-circuit configuration. For balancing the sensitivity difference, the voice coil of a sound generator with 3-magnetic-circuit configuration generally has an internal diameter greater than that of the voice coil of a sound generator with 5-magnetic-circuit configuration. However, increased internal diameter will cause more obvious high frequency divided vibration, and further bring more obvious pit to the high frequency resonance, which will badly affect the acoustic performance of the sound generator.

Therefore, it is necessary to provide an improved sound generator to solve the problems mentioned above.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
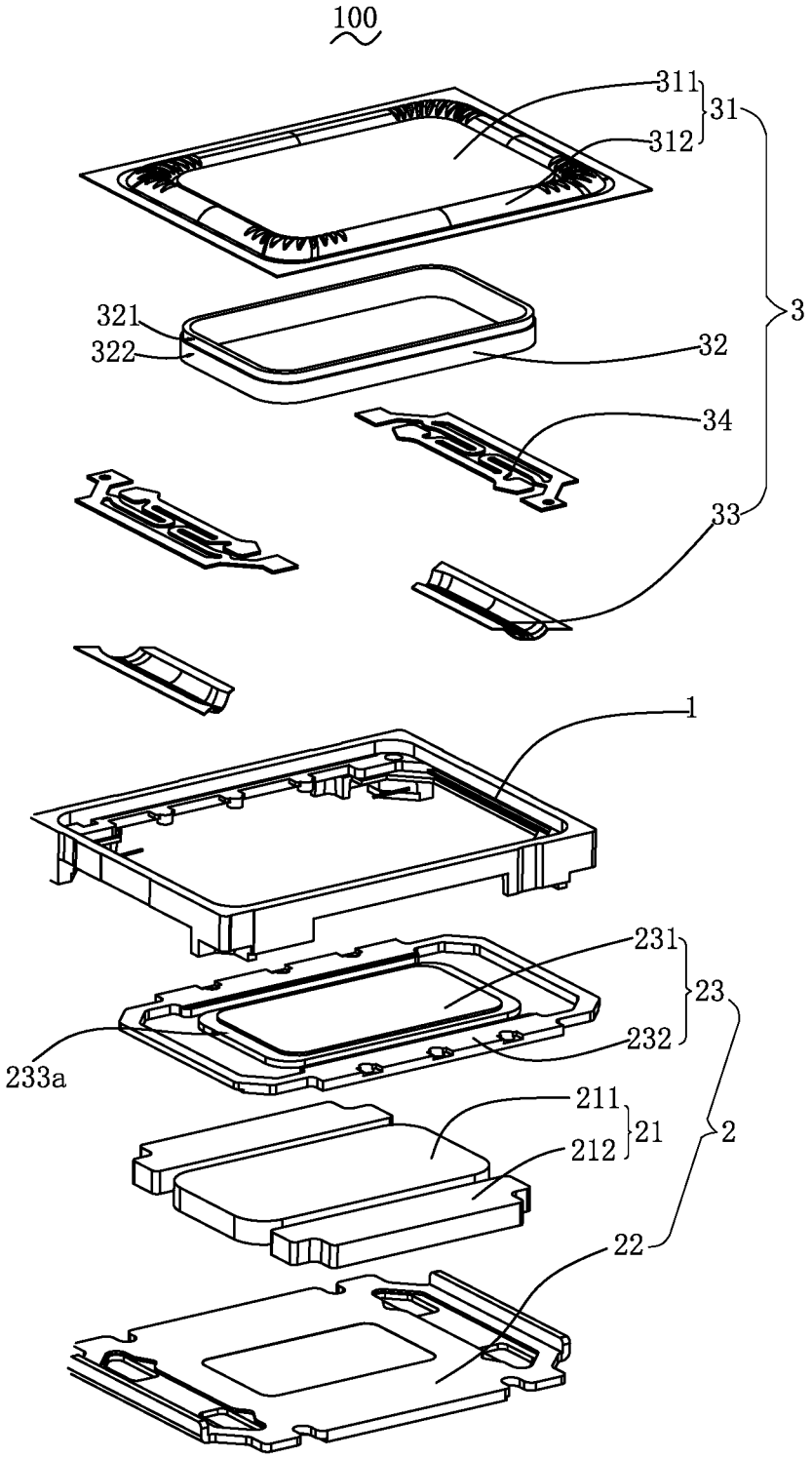
FIG. 1 is an isometric and exploded view of a sound generator in accordance with an exemplary embodiment of the present disclosure.
Figure 2:
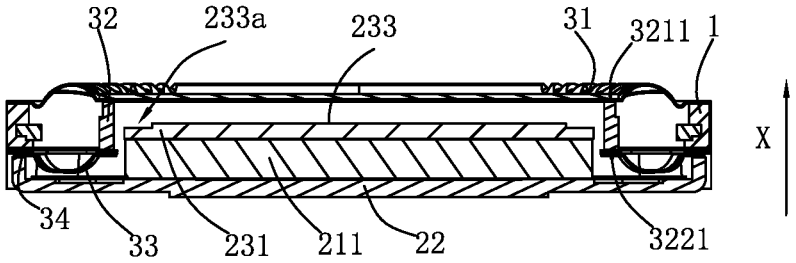
FIG. 2 is a cross-sectional view of the sound generator in FIG. 1.
Figure 3:
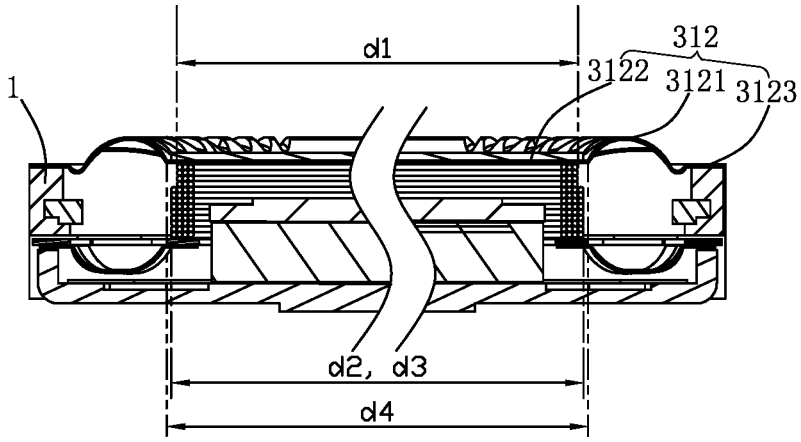
FIG. 3 is an enlarged view of FIG. 2.

Referring to FIGS. 1-3, a sound generator 100, in accordance with an exemplary embodiment of the present disclosure, includes a frame 1, a magnetic circuit system 2 positioned by the frame 1, and a vibration system 3 assembled with the frame 1.

The magnetic circuit system 2 includes a magnetic yoke 22, a magnet 21 carried by the magnetic yoke 22, and a pole plate 23 attached to a top of the magnet 21. The magnet 21 includes a main magnet 211 and a pair of auxiliary magnets located at two sides of the main magnet 211, for forming a magnetic gap therebetween. In the embodiment, the auxiliary magnets 212 have rectangular shapes.

The pole plate 23 is made of magnetic conductive material for gathering the magnetic field to improve magnetic induction performance. The pole plate 23 includes a main plate 231 attached to the main magnet 21 and an auxiliary plate 232 attached to the auxiliary magnets 212. In the embodiment, the auxiliary plate 232 is a ring and covers the auxiliary magnets 212. The pole plate 23 comprises a third surface 233 away from the main magnet 21, with an annular step 233*a* recessed from an edge of the third surface 233 towards the main magnet 21 along a vibration direction X of the vibration system 3.

The vibration system 3 includes a diaphragm 31 and a voice coil 32 for driving the diaphragm 31 to vibrate. The diaphragm 31 includes a dome 311 and a membrane 312. The voice coil 32 is partially located in the magnetic gap and is forced to move along a vibration direction by the Ampere Force generated due to the electrified voice coil and the magnetic field.

The membrane 312 includes a suspension 3121, a central portion 3122 surrounded by the suspension 3121, and a positioning portion 3123 surrounding the suspension 3121. The dome is attached to a side of the central portion 3122 far away from the voice coil 32. The positioning portion 3123 is fixed to the frame 1.

The voice coil 32 includes a first surface 3211 adjacent to the diaphragm 31 and a second surface 3221 far away from the diaphragm 31. Optionally, the first surface 3211 is connected to the central portion 3122.

The voice coil 32 includes a first outer diameter d1 on the second outer diameter 3211, and a second outer diameter d2 on the second surface 3221 greater than the first outer diameter d1. The dome 311 has an outer diameter d3 not smaller than the second outer diameter d2. By such a configuration, an area between the voice coil 32 and the diaphragm 31 for bounding each other is reduced, and the outer diameter of the diaphragm 32 is accordingly reduced, which weakens the split vibration of the dome 311 at high frequency, and improves the frequency resonance performance of the sound generator 100. When the voice coil 32 is bonded to the membrane 312, and the first outer diameter d1 of the first surface 3211 is smaller than the second outer diameter d2 of the second surface 3221, excess glue can be stored between the membrane 312 and the first part 321. However, during processing, it is inevitable that glue will overflow along the surface of the voice coil 32 close to the main plate 231 and cover the surface of the voice coil 32, so that the voice coil 32 becomes wider. Therefore, an annular step 233*a* arranged on the edge of the third surface 233 of the main plate 231 can prevent the voice performance degradation caused by the collision between the widened voice coil 32 and the main plate 231.

In detail, the voice coil 32 includes a first part 321 adjacent to the diaphragm 31 and a second part 322 far away from the diaphragm 322. The first surface 3211 is located on the first part 321, and the second surface 3221 is located on the second part 322. The outer diameter of the first part 321 is equal to the first outer diameter d1, and the outer diameter of the second part 322 is equal to the second outer diameter d2. The first and second parts are both formed by winding conductive wires, and the lap's number of the first part is less than that of the second part. The most outer layer of the voice coil 32 is defined as a tailend layer (last layer), which is wound obliquely from a top of the penult layer adjacent to the diaphragm in a direction away from the diaphragm, which reduces the lap's number of the voice coil connecting with the diaphragm, and reduces the area for bounding the coil and the diaphragm. Accordingly, the split vibration at high frequency is weakened, and frequency resonance is improved.

Figure 4:
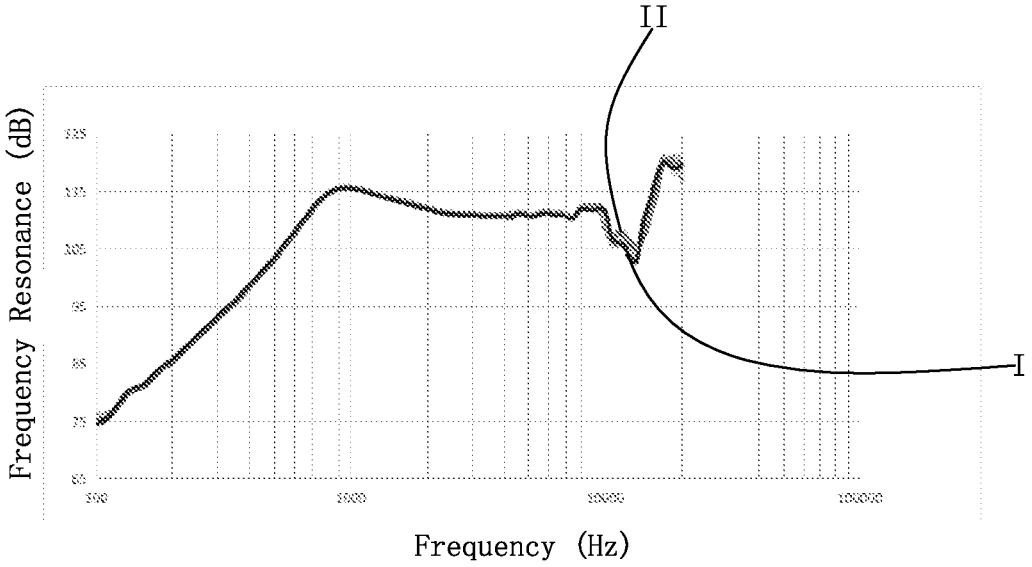
FIG. 4 shows a comparison of frequency resonance curves of the related sound generator and the sound generator provided by the present disclosure.

Referring to FIG. 4, a comparison between frequency-resonance curves of related sound generator and the sound generator provided by the present invention is shown. Curve I shows the frequency-resonance of a related sound generator with 3-magnetic-circuit, and Curve II shows the frequency-resonance of the sound generator 100 of the present invention. An obvious difference could be seen at near 13 KHz. At 13 KHz, split vibration of Curve II is slighter than the split vibration of Curve I. According to the comparison, a valley point of the frequency-resonance of Curve II is shallower than that of Curve I, which proves that high frequency-resonance of the sound generator by the present invention is better than that of a related 3-magnetic-circuit sound generator, and proves that the acoustic performance is improved.

In addition, an outer diameter d4 of the central portion 3122 is greater or equal to the outer diameter d3 of the dome 311, which avoids the potential risk of crash between the dome 311 and the suspension 3121. The vibration system 3 further includes an auxiliary diaphragm 33 and a second suspension 34 having an end connected to the voice coil 32 and another end fixed to the frame 1. The auxiliary diaphragm 33 is fixed to a side of the second suspension 34 far away from the voice coil 32.

Compared with the related sound generator, the voice coil is formed by a different wire winding method, which improves the high frequency pit of the sound generator. The most outer layer of the voice coil is not completely wound such that the most outer layer reduces the contacting area between the dome and the voice coil, which reduces the split vibration of the dome at high frequency and improves the high frequency-resonance performance.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A sound generator, comprising:

a frame;

a magnetic circuit system fixed by the frame;

a vibration system fixed by the frame, including a diaphragm and a voice coil for driving the diaphragm; wherein the diaphragm includes a membrane, and a dome attached to the membrane;

the voice coil is formed by continuously wound conductive wires;

the voice coil includes a first surface adjacent to the diaphragm and a second surface far away from the diaphragm; the voice coil includes a first part adjacent to the diaphragm for defining the first surface and a second part far away from the diaphragm for defining the second surface; the voice coil is directly fixed on the membrane through the first part; the first and second parts are formed by continuously wound conductive wires, and a lap's number of the second part is greater than that of the first part;

a first outer diameter of the first surface is smaller than a second outer diameter of the second surface, and an outer diameter of the dome is greater than or equal to the second outer diameter.

2. The sound generator as described in claim 1, wherein the first part having the first outer diameter, and the second part having the second outer diameter.

3. The sound generator as described in claim 1, wherein the membrane further includes a suspension, a central portion surrounded by the suspension, and a positioning portion surrounding the suspension, the first surface of the voice coil is connected to the central portion, and the dome is attached to a side of the central portion far away from the voice coil.

4. The sound generator as described in claim 3, wherein an outer diameter of the central portion is greater or equal to an outer diameter of the dome.

5. The sound generator as described in claim 1, wherein the magnetic circuit system comprises a magnetic yoke, a magnet attached to the magnetic yoke and a pole plate attached to a top of the magnet, the magnet comprises a main magnet and a pair of auxiliary magnets located at two sides of the main magnet, the pole plate comprises a main plate attached to the main magnet and an auxiliary plate attached to the auxiliary magnets.

6. The sound generator as described in claim 5, wherein the main plate comprises a third surface away from the main magnet, with an annular step recessed from an edge of the third surface towards the main magnet along a vibration direction of the vibration system.

* * * * *